United States Patent [19]

MacHose

[11] Patent Number: 4,493,504

[45] Date of Patent: Jan. 15, 1985

[54] CARRIER FOR TRANSPORTING PAINTINGS AND OTHER SUBSTANTIALLY PLANAR ARTWORK

[76] Inventor: Robert L. MacHose, Rte. 1, Box 84, Zionsville, Pa. 18092

[21] Appl. No.: 417,481

[22] Filed: Sep. 13, 1982

[51] Int. Cl.[3] ..... B65D 71/00

[52] U.S. Cl. ..... 294/146; 294/143; 294/163; 294/165

[58] Field of Search ..... 294/16, 34, 137, 138, 294/141–143, 146, 159, 160, 162–165, 167–169; 206/1.7, 451, 454–456, 575; 150/52 R, 52 B

[56] References Cited

U.S. PATENT DOCUMENTS

| | | | |
|---|---|---|---|
| 295,030 | 3/1884 | Marot | 294/165 |
| 728,450 | 5/1903 | Everett . | |
| 941,212 | 11/1909 | Tolman . | |
| 1,432,336 | 10/1922 | Hurley . | |
| 2,288,325 | 6/1942 | Rodier . | |
| 2,433,037 | 12/1947 | Ferris . | |
| 2,613,860 | 10/1952 | Hoffman . | |
| 2,875,934 | 3/1959 | Barg . | |
| 3,281,031 | 10/1966 | Shapiro . | |
| 3,563,432 | 2/1971 | Sage et al. . | |
| 4,081,119 | 3/1978 | Messmore . | |

FOREIGN PATENT DOCUMENTS

| | | | |
|---|---|---|---|
| 122637 | 8/1948 | Sweden | 294/142 |
| 127944 | 4/1950 | Sweden | 294/142 |
| 6709 | of 1910 | United Kingdom | 294/142 |

*Primary Examiner*—Johnny D. Cherry

*Attorney, Agent, or Firm*—Dann, Dorfman, Herrell and Skillman

[57] ABSTRACT

A carrier for transporting paintings and other substantially planar artwork comprises a pair of generally parallel elongated support members mounted upon a generally transverse guide member for relative adjustment toward and away from each other to adjust the distance to conform to the corresponding dimension of a piece of artwork to be transported. Retainers are provided for retaining the support members in the adjusted position to retain the artwork in place. The support members each include a seat for preventing lateral movement of the artwork. A protective member is provided, the protective member being hinged to the first guide member to afford relative displacement of the first guide member and the protective member between an open and a closed position. When the protective member is in the closed position, it is held parallel to the artwork with sufficient clearance therebetween to avoid impingement by the protective member against the adjacent surface of the artwork.

6 Claims, 4 Drawing Figures

CARRIER FOR TRANSPORTING PAINTINGS AND OTHER SUBSTANTIALLY PLANAR ARTWORK

BACKGROUND OF THE INVENTION

The present invention relates generally to a carrier for transporting paintings and other substantially planar artwork and, more particularly, to such a carrier which facilitates the transportation of two such pieces of artwork while the artwork is still wet.

DESCRIPTION OF THE PRIOR ART

It is often necessary or desirable to transport two substantially planar pieces of artwork, such as paintings, from one location to another. For example, an artist working in a remote scenic location, such as near a mountain, lake or the like, may wish to transport recently completed wet oil paintings from the scenic location where the paintings were produced to some other location, such as his home or studio, to put the final touches on the paintings and to allow the paintings to completely dry. Of course, one way to carry such paintings would be to simply pick them up by hand and carry them along. However, carrying a single painting in this manner is difficult to do without running the risk of either smearing the painting or getting paint upon the hands or clothing of the person carrying the painting, particularly if the painting must be transported a substantial distance. In addition, while it may be feasible to transport a single painting over a short distance in this manner, it is exceedingly more difficult to do so when there are two such wet paintings involved.

Various prior art methods and apparatus have been developed to facilitate the transportation of two such wet paintings. One prior art apparatus employs a plurality of clips (two at the bottom and at least one at the top) for retaining the two wet paintings together in a parallel spaced relation with the painted surfaces facing each other and a handle which attaches to the top clip. Another prior art apparatus employs a single clip member (which includes a handle) which may be used to hook the two wet paintings together by inserting a sleeve portion between each of the canvases and its respective stretcher.

While the various prior art methods of carrying wet paintings may have achieved some limited success, they are all somewhat difficult to employ and most of them require that the two wet paintings being carried are of substantially the same size. The present invention provides an inexpensive carrier for transporting paintings and other substantially planar artwork which is relatively simple to utilize and permits the transporting of two paintings or other such artwork of differing sizes and thicknesses.

SUMMARY OF THE INVENTION

Briefly stated, the present invention comprises a carrier for transporting paintings and other substantially planar artwork. The carrier comprises a first elongated support member having a seat for receiving a first edge of a first piece of artwork. A second elongated support member having a seat for receiving a second edge of the artwork is positioned generally parallel to and spaced apart from the first support member. A first elongated guide member extends generally transverse to the first and second support members, the first and second support members being mounted upon the first guide member for relative adjustment toward and away from each other to adjust the distance between the support members to conform to the corresponding dimension of the artwork. Retainer means are provided for retaining the support members in the adjusted position to retain the artwork in place. A protective member is provided. The protective member may comprise a third elongated support member, a fourth elongated support member and a second elongated guide member, the third and fourth elongated support members and the second elongated guide member being arranged in the same manner as the first and second elongated support members and the first guide member. Hinge means are provided between the first guide member and the protective member to afford relative displacement of the first guide member and the protective member between an open and a closed position. Spacer means is provided on at least the guide member or the protective member and abutting against the other in the closed position to space the protective member parallel to the artwork with sufficient clearance therebetween to avoid impingement by the protective member against the adjacent surface of the artwork.

BRIEF DESCRIPTION OF THE DRAWINGS

The foregoing summary, as well as the following detailed description of a preferred embodiment of the present invention, will be better understood when read in conjunction with the accompanying figures, in which.

DESCRIPTION OF THE PREFERRED EMBODIMENT

Figure 1:
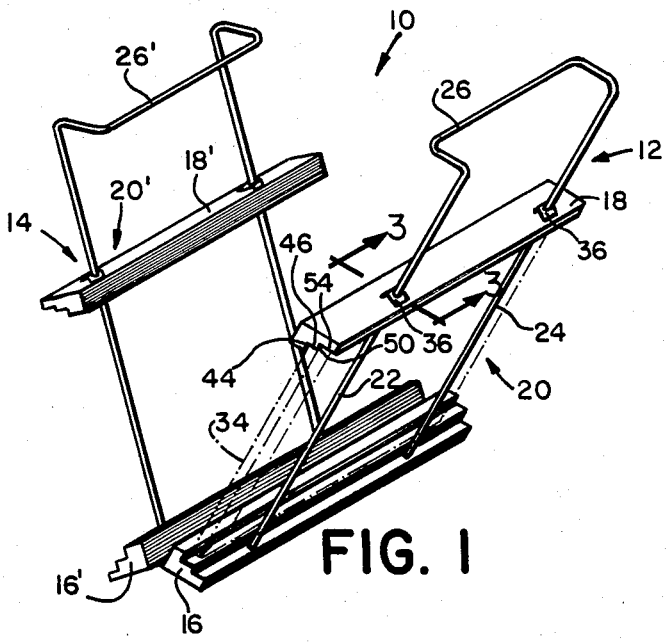
FIG. 1 is a perspective view of a carrier in accordance with the present invention.

Referring to the drawing, and particularly to FIG. 1, there is shown a carrier 10 for transporting paintings, particularly wet paintings, and other substantially planar artwork in accordance with the present invention. The carrier 10 is comprised of two substantially identical sub assemblies 12 and 14 which are hinged together in generally abutting relationship in a manner which will hereinafter be described. For purposes of clarity and brevity in the present application, only the structure of the first sub assembly 12 will be described in detail, it being understood that the structure of the second assembly 14 is the same.

The first sub assembly 12 is comprised of a first elongated support member 16 and a second elongated support member 18 positioned generally parallel to and spaced apart from each other. In the present embodiment, both the first and second support members 16 and 18 are comprised of wood strips. However, either or both of the support members 16 and 18 could be comprised of any other suitable rigid or semi-rigid material such as plastic.

The first and second support members 16 and 18 are slidably mounted upon a first generally vertically oriented elongated guide member 20. The first guide member 20 is comprised of two generally parallel and spaced apart vertical guide rods 22 and 24 which are connected together at their respective first or upper ends by a generally U-shaped handle means 26. In the present embodiment, the guide rods 22 and 24 and the U-shaped handle means 26 are comprised of a single continuous cylindrical ¼ inch metallic rod which has been formed or bent to the shape as shown on FIG. 1. It should be appreciated that the present invention is not limited to such a one piece structure nor is the present invention limited to such a metallic or cylindrical structure.

Figure 3:
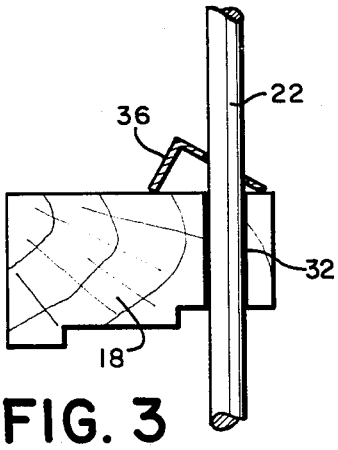
FIG. 3 is a cross-sectional view of a portion of the carrier taken along lines 3—3 of FIG. 1 showing two different kinds of artwork being carried.

The first and second support members 16 and 18 are slidably mounted upon the guide rods 22 and 24 for relative adjustment toward and away from each other to adjust the distance therebetween to conform to the dimension of the artwork to be transported therebetween. In the present embodiment, the second or lower ends of the guide rods 22 and 24 extend through a pair of suitably sized and positioned, generally circular openings 28 extending through the first support member 16 (only one such opening being shown on FIG. 2). A pair of speed nuts 30 (only one of which is shown on FIG. 2) are installed on the lower ends of the guide rods 22 and 24 for supporting and retaining the first support member 16 thereon. The second support member 18 also has a pair of suitably sized and positioned, generally circular openings 32 extending therethrough (only one of which is shown on FIG. 3) through which extend the guide rods 22 and 24.

Although both of the support members 16 and 18 are generally free to slide or move up and down along the guide rods 22 and 24, when the carrier 10 is in the upright or operative position as shown on FIG. 1, the first support member 16 slides downwardly along the guide rods 22 and 24 to the lower end of the guide rods 22 and 24 as shown. A suitable wet painting or other generally planar piece of artwork 34 (shown in phantom on FIG. 1) of any given height may be placed on the first support member 16 as shown. The second support member 18 may then be adjusted toward or away from the first support member 16, depending upon the height of the artwork 34, to conform the space between the support members 16 and 18 to the height of the artwork 34 and to thereby hold or retain the artwork 34 therebetween.

Retainer means, in the present embodiment two metallic L-shaped clips 36, are employed for retaining the second support member 18 in its adjusted position (shown on FIG. 1) to put downward pressure upon the artwork 34 and thus to retain the artwork 34 in place between the support members. The metallic clips 36 are of a type which are well known in the art and may be obtained commercially. As long as the second or upper support member 18 is in contact with the artwork 34, the clips 36 function to push downwardly on the second support member 18 against the opposing upward pressure created by the artwork 34 to maintain the second support member in the adjusted position as shown, abutting tightly against the artwork 34.

By employing the carrier as thus far described and positioning the artwork 34 between the first and second support members 16 and 18 as shown, the artwork 34 is relatively snugly secured against vertical movement. However, it is also desirable to prevent the artwork 34 from moving laterally and sliding out from in between the two support members 16 and 18. For this purpose, a first generally vertical shoulder 38 extends along the length of the first elongated member 16 as shown. The shoulder 38 and the two guide rods 22 and 24 cooperate to form a first generally horizontal notch or seat 40 in the upper surface of the first support member 16 for receiving a first or lower edge 42 of the artwork 34. It will be appreciated that the width of the seat 40 may be slightly larger than the width of a typical artist's frame mounted canvas. In the present embodiment, the width of the seat (the distance between the shoulder 38 and the guide rods 22 and 24) is approximately ⅞ of an inch.

The second or upper elongated support member 18 includes a complimentary first vertical shoulder 44 extending similarly along the length thereof. The shoulder 44 in the second support member 18 similarly cooperates with the guide rods 22 and 24 to form a seat 46 in the lower surface of the second support member 18. As shown, the seats 40 and 46 on both of the support members 16 and 18 are generally aligned and parallel to each other. Thus, a second or upper edge of the artwork 34 opposite the first edge 42 is received within seat 46 of the second or upper support member 18, when the second support member 18 is in the adjusted or retaining position as shown, to prevent lateral movement of the artwork 34.

Although the carrier thus far described is adequate for transporting a single wet painting such as a standard size artist's canvas, many times an artist may create a painting upon a thinner surface such as a piece of masonite or composition board, typically having a thickness of approximately ⅛ of an inch. In order to similarly retain such a thinner piece of artwork from lateral movement, both the first and second support members 16 and 18 have corresponding complimentary second generally vertical shoulders 48 and 50 therein. The second shoulders 48 and 50 also cooperate with the guide rods 22 and 24 to form complimentary second seats 52 and 54 within the support members 16 and 18. The second seats 52 and 54 are aligned and generally parallel to each other for receiving the opposite edges of a thin (i.e., ⅛ inch in thickness) piece of planar artwork (see FIG. 2). In the present embodiment, the second seats 52 and 54 are approximately 3/16 of an inch wide.

As mentioned briefly above, the carrier 10 is comprised of first and second identical sub assemblies 12 and 14, respectively, the structure of the first sub-assembly 12 having been described in detail above. It is apparent from the drawings that the second sub-assembly 14 similarly comprises a third elongated support member 16' and a fourth elongated support member 18' of the type described above. Both the third and fourth support members 16' and 18' are mounted upon a second, elongated guide member 20' of the type previously described with a handle means 26' on the upper end thereof. Both the third and fourth support members 16' and 18' include first and second shoulders which cooperate with the second guide member 20' to establish first and second seats for the lateral retention of different sized artwork therein.

Figure 2:
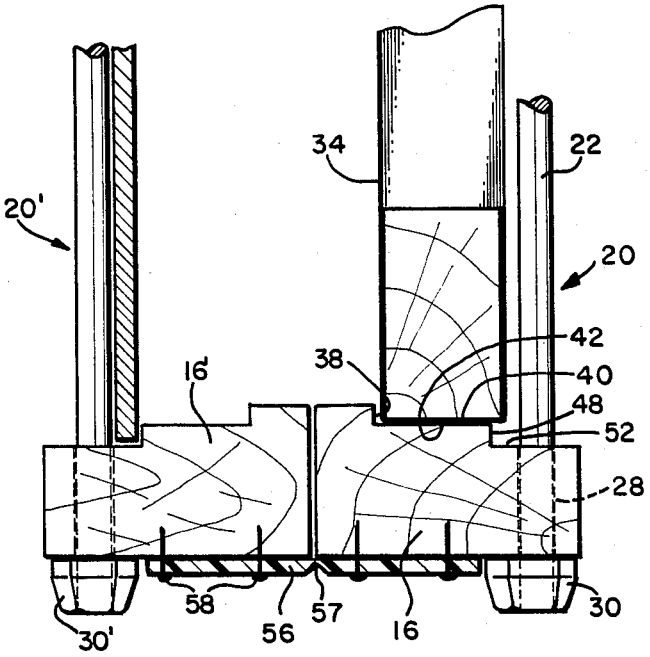
FIG. 2 is an enlarged left side elevation view of a portion of the carrier of FIG. 1 with two different types of paintings positioned therein.

The two carrier sub assemblies 12 and 14 are connected together at the lower end by a hinge means 56 as shown on FIG. 2. In the present embodiment, the hinge means comprises a strip of flexible plastic material which extends along the entire length of the first and third support members 16 and 16' and is attached to the bottoms of both the first and third support members 16 and 16' by suitable staples 58 and/or glue (not shown). Alternatively, the hinge means 56 may be formed of some other suitable material such as steel (not shown) and/or may comprise two or more individual hinge pieces (not shown) which are attached to both the first and third support members 16 and 16' at various places along their respective lengths.

The hinge means 56 permits the limited separation of the first and second sub assemblies 12 and 14 into an open position as shown on FIG. 1 to facilitate the installation and removal of artwork from either or both of the sub assemblies 12 and 14. A notch 57 extends along the length of the hinge means 56 at the junction of the first and third support members 16 and 16' to facilitate the flexing of the hinge means to open and close the carrier 10. Once the artwork has been installed (in the manner as described above) between the supporting members 16/18 and 16'/18' of both sub assemblies 12 and 14 with the wet or finished sides of the artwork facing each other, the two sub assemblies 12 and 14 may be swung or pivoted about the hinge member 56 to a closed or carrying position as shown on FIGS. 2 and 4.

When the carrier 10 is in the closed position, the first and third support members 16 and 16' abut as shown on FIG. 2 to provide a stop or spacer means to prevent the adjacent wet painted surfaces of the two pieces of artwork from engaging and possibly smearing each other. Likewise, as shown on FIG. 4, the two handle means 26 and 26' similarly abut to provide spacer means for maintaining the two pieces of artwork in a spaced apart parallel relation with each other. As shown on FIG. 4, the handle means 26 slopes downwardly toward one direction while handle means 26' slopes downwardly toward the other direction, causing the handles to abut at only one point along their respective lengths. In this manner, if the handle means 26 and 26' are slightly misaligned, they will still abut as shown to maintain the spacing between the two pieces of artwork. In the event that the two pieces of artwork are of the exact same height, the upper support members (second and fourth support members) 18 and 18' similarly abut as shown on FIG. 4 to further help prevent the two pieces of artwork from engaging each other. However, if artwork of different heights is being carried, the upper support members 18 and 18' will not abut each other.

Figure 4:
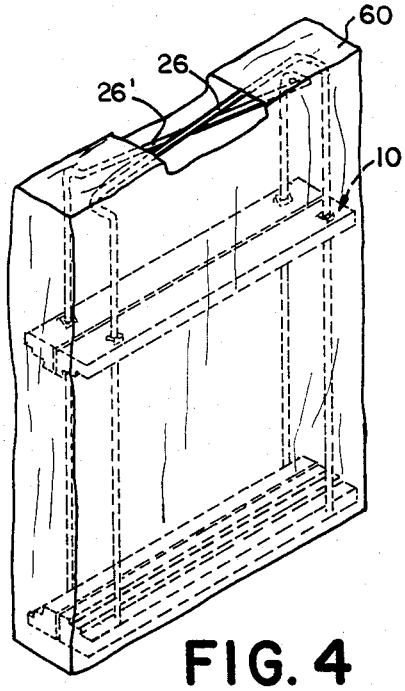
FIG. 4 is a perspective view of a cover for the carrier of FIG. 1.

Once the two pieces of artwork are properly positioned and the carrier 10 is in the closed position as shown on FIG. 2 or 4, the carrier 10 may be picked up by the handle members 26 and 26' and transported. The close proximity of the two pieces of artwork to each other serves to prevent the intrusion of foreign objects therebetween and to otherwise protect the adjacent wet surface of each piece of artwork from possible smearing or other such damage. In the event that only one wet painting is to be transported, a second dry painting or a blank canvas may be installed within one of the subassemblies to protect the single wet painting. The first and second sub assemblies 12 and 14 are held together in the closed position by holding onto the handle means 26 and 26'. Alternatively, a suitable retaining means, such as a wire twister or the like (not shown), may be provided to maintain the two handle means 26 and 26' in abutting relationship.

It is also apparent from FIG. 2 that the four speed nuts 30 and 30' (only two of which are shown) serve as legs to support the carrier 10 when the carrier is resting upon a flat surface and to protect the hinge means 56 from undue wear.

FIG. 4 shows the carrier 10 in the closed position with a plastic carrying cover 60 extending over the entire carrier 10. The plastic cover provides suitable protection from the elements for both the carrier 10 and any artwork which may be retained therein. A suitable opening in the top of the plastic cover facilitates handling and transporting of the carrier 10.

From the foregoing description and the appended drawing, it can be seen that the present invention provides an inexpensive carrier for transporting paintings and other substantially planar artwork which is relatively simple to utilize and permits the safe transporting of two paintings or other such artwork of differing sizes and thicknesses. It will be recognized by those skilled in the art that changes or modifications may be made to the above-described embodiment without departing from the broad inventive concepts of the invention. For example, a plurality of bumps or individual shoulder sections may be employed along the length of the various support members to replace the various shoulders in creating the seats on the support members. Alternatively, the second sub assembly 14 could be replaced by a substantially one-piece planar protective member (not shown) to allow for the safe transporting of a single piece of artwork in the first sub assembly 12. It is understood, therefore, that this invention is not intended to be limited to the particular embodiment described, but it is intended to cover all changes and modifications which are within the scope and spirit of the invention as set forth in the appended claims.

I claim:

1. A carrier for transporting paintings or other substantially planar artwork, comprising two assemblies, each assembly comprising:

a first elongated support member having a seat for receiving a first edge of a piece of artwork;

a second elongated support member having a seat for receiving a second edge of said artwork opposite said first edge, the second support member being positioned generally parallel to and spaced apart from the first support member with the seat of the second support member facing the seat of the first support member;

an elongated guide member comprising two generally parallel spaced apart guide rods extending through said support members in such a manner as to permit sliding adjustment of at least one support member on the guide rods so as to permit adjustment of the distance between the support members to conform to the corresponding dimension of said artwork so that in the adjusted position of said support members, the first and second edges of said artwork are received within the respective seats of the support members;

retainer means for retaining the support members in the adjusted position to retain said artwork in place between the support members;

said carrier further comprising:

hinge means between the assemblies adjacent one end of the guide members permitting relative displacement of said assemblies between an open and a closed position;

spacer means on the guide member of at least one of the assemblies in the closed position to space the artwork in one of the assemblies from the other assembly or any artwork therein with sufficiently large clearance therebetween to avoid impingement by the other assembly or the artwork therein against the adjacent surface of said artwork.

2. The carrier as recited in claim 1 wherein the seat of each support member comprises at least one shoulder of predetermined width extending along the length of the support member.

3. The carrier as recited in claim 1 where the guide members of each assembly further include handle means on the end of said guide members distal to said hinge means for facilitating the handling of the carrier.

4. The carrier as recited in claim 1 wherein the retainer means comprises:

permanent fasteners for retaining one of the elongated support members of each assembly fixed at a first end of said guide members with the hinge means between said pair of fixed support members; and adjustable fasteners for maintaining the other elongated support member of each assembly in its adjusted position.

5. The carrier as recited in claim 4 wherein the guide member of each assembly is generally U-shaped with the open end of the U attached to the support members and the parallel legs of the U bent so the closed ends extend toward one another and are positioned to abut in the closed position to provide the spacer means.

6. The carrier as recited in claim 5 wherein the closed ends of the U-shaped guide members abut at only a single joint along their respective lengths.

* * * * *